US011639589B2

(12) United States Patent
Harvey et al.

(10) Patent No.: US 11,639,589 B2
(45) **Date of Patent: *May 2, 2023**

(54) SNOWBANK DECONSTRUCTING SYSTEM

(71) Applicant: Klondike Robotics Corporation, Ashland, MA (US)

(72) Inventors: Edward Harvey, Ashland, MA (US); Alex Whittemore, Redondo Beach, CA (US); Anthony M. Duys, Merrimac, MA (US)

(73) Assignee: Klondike Robotics Corporation, Ashland, MA (US)

( * ) Notice: Subject to any disclaimer, the term of this patent is extended or adjusted under 35 U.S.C. 154(b) by 148 days.

This patent is subject to a terminal disclaimer.

(21) Appl. No.: 17/179,945

(22) Filed: Feb. 19, 2021

(65) Prior Publication Data

US 2021/0254294 A1 Aug. 19, 2021

Related U.S. Application Data

(60) Provisional application No. 62/978,585, filed on Feb. 19, 2020.

(51) Int. Cl.

| | |
|---|---|
| ***E01H 5/08*** | (2006.01) |
| ***E01H 5/12*** | (2006.01) |
| ***E01H 5/06*** | (2006.01) |
| ***E01H 5/07*** | (2006.01) |
| ***E01H 5/10*** | (2006.01) |

(52) U.S. Cl.

CPC ..... *E01H 5/12* (2013.01); *E01H 5/065* (2013.01); *E01H 5/07* (2013.01); *E01H 5/08* (2013.01); *E01H 5/106* (2013.01)

(58) Field of Classification Search

CPC .. E01H 5/065; E01H 5/07; E01H 5/08; E01H 5/106; E01H 5/12

See application file for complete search history.

(56) References Cited

U.S. PATENT DOCUMENTS 2,670,862 A * 3/1954 Siebring ..... E01H 5/07 414/724
5,140,763 A * 8/1992 Nichols, IV ..... E01H 5/062 37/270
5,819,443 A * 10/1998 Winter ..... E01H 5/066 37/232

(Continued)

OTHER PUBLICATIONS

International Search Report and Written Opinion dated Sep. 1, 2022 in PCT Application Serial No. PCT/US2021/018742.

(Continued)

*Primary Examiner* — Gary S Hartmann

(74) *Attorney, Agent, or Firm* — Brian J. Colandreo; Heath M. Sargeant; Holland & Knight LLP

(57) ABSTRACT

An autonomous snowbank deconstructing system includes an autonomous vehicle, one or more boom arms coupled to the autonomous vehicle, and a dulled shovel component coupled to the one or more boom arms. The autonomous vehicle is configured to autonomously gather loose debris to form one or more debris piles with repetitive, low-impact contact of the dulled shovel component with the loose debris, and autonomously deconstruct accumulated debris with repetitive, low-impact contact of the dulled shovel component with the accumulated debris.

2 Claims, 13 Drawing Sheets

(56) References Cited

U.S. PATENT DOCUMENTS

| | | | | |
|---|---|---|---|---|
| 6,829,973 | B1 * | 12/2004 | Yang | B23D 61/025 83/835 |
| 7,051,390 | B2 * | 5/2006 | van Beek | B25F 1/00 7/146 |
| 7,293,361 | B1 * | 11/2007 | Miller | F25C 5/043 173/90 |
| 11,054,830 | B2 * | 7/2021 | Anderson | B60L 15/20 |
| 2010/0243633 | A1 * | 9/2010 | Huynh | H02G 7/16 219/209 |
| 2015/0308063 | A1 * | 10/2015 | Charbonneau | E01H 5/12 299/25 |
| 2021/0108392 | A1 * | 4/2021 | Hahn | E02F 3/3654 |

OTHER PUBLICATIONS

International Search Report and Written Opinion dated Sep. 1, 2022 in PCT Application Serial No. PCT/US2021/018755.

* cited by examiner

SNOWBANK DECONSTRUCTING SYSTEM

RELATED APPLICATION(S)

This application claims the benefit of U.S. Provisional Application No. 62/978,585, filed on 19 Feb. 2020, the entire contents of which are incorporated herein by reference.

TECHNICAL FIELD

This disclosure relates to snowbank deconstructing systems and, more particularly, to autonomous snowbank deconstructing systems.

BACKGROUND

When clearing snowbanks, snow blowers with high-powered augers and impeller that grind and power through the material are normally used. However, this is fundamentally dangerous to humans and impractical for autonomous systems. For example, even if human-level artificial intelligence could be utilized in autonomous systems, snow blowers operated by humans result in tens of thousands of injuries and emergency room visits per year. Therefore, use of an autonomous snow blower to deconstruct or dislodge snowbanks is fundamentally unsafe, regardless of how well-developed an artificial intelligence system may be.

SUMMARY OF DISCLOSURE

In one implementation, an autonomous snowbank deconstructing system includes an autonomous vehicle and a dulled motorized instrument coupled to the autonomous vehicle and configured to make repetitive, low-impact contact with accumulated snow.

One or more of the following features may be included. The dulled motorized instrument may be configured to be safe to human touch during the repetitive, low-impact contact with the accumulated snow. The dulled motorized instrument may include a first dulled blade configured to reciprocate with respect to a second dulled blade. The autonomous snowbank deconstructing system may include a shovel component, wherein the dulled motorized instrument may be configured to be coupled to the shovel component. The autonomous vehicle may be configured to move snow with the shovel component and deconstruct the accumulated snow with the dulled motorized instrument. The autonomous snowbank deconstructing system may include one or more boom arms, where the dulled motorized instrument may be coupled to the one or more boom arms. The one or more boom arms include one or more articulating boom arms. The one or more boom arms include one or more telescopic boom arms. The dulled motorized instrument may include one or more of: a vibrating component, and a heating component. The dulled motorized instrument may include a dulled saw.

In another implementation, an autonomous snowbank deconstructing system includes an autonomous vehicle, one or more boom arms coupled to the autonomous vehicle, and a dulled shovel component coupled to the one or more boom arms. The autonomous vehicle is configured to: autonomously gather loose debris to form one or more debris piles with repetitive, low-impact contact of the dulled shovel component with the loose debris; and autonomously deconstruct accumulated debris with repetitive, low-impact contact of the dulled shovel component with the accumulated debris.

One or more of the following features may be included. The dulled shovel component may be configured to be safe to human touch during the repetitive, low-impact contact of the dulled shovel component with the loose debris and the repetitive, low-impact contact of the dulled shovel component with the accumulated debris. The autonomous snowbank deconstructing system may include a dulled motorized instrument coupled to the autonomous vehicle and configured to make repetitive, low-impact contact with accumulated debris. The one or more boom arms may include one or more articulating boom arms. The one or more boom arms may include one or more telescopic boom arms. The dulled motorized instrument may include a dulled saw. The one or more booms arms include a first boom arm coupled to one end of the dulled shovel component and a second boom arm coupled to an opposite end of the dulled shovel component. One or more of the first boom arm and the second boom arm may be telescoping boom arms.

In another implementation, an autonomous snowbank deconstructing system includes an autonomous vehicle, one or more boom arms coupled to the autonomous vehicle, a shovel component coupled to the one or more booms arms, and a dulled motorized instrument coupled to the shovel component and configured to make repetitive, low-impact contact with accumulated snow. The dulled motorized instrument may include a dulled saw configured to actuate along at least one of a lateral axis and a longitudinal axis of the shovel component.

One or more of the following features may be included. The dulled motorized instrument may be configured to be safe to human touch during the repetitive, low-impact contact with the accumulated snow.

The details of one or more implementations are set forth in the accompanying drawings and the description below. Other features and advantages will become apparent from the description, the drawings, and the claims.

BRIEF DESCRIPTION OF THE DRAWINGS

Like reference symbols in the various drawings indicate like elements.

DETAILED DESCRIPTION OF THE PREFERRED EMBODIMENTS

Referring to FIGS. 1-13B, there are shown various views of a snowbank deconstructing system and an autonomous snowbank deconstructing system that, as will be discussed below in greater detail, may allow for the safe deconstruction or dislodging of accumulated snow. For example and as discussed above, conventional approaches to moving and dislodging snow involve heavy machinery with high-powered augers that grind and power through the material. However, this is fundamentally dangerous to humans and impractical for autonomous systems. For example, even if human-level artificial intelligence could be utilized in an autonomous snow removal vehicle, high-powered equipment like snow blowers operated by humans result in tens of thousands of injuries and emergency room visits per year. Therefore, use of an autonomous snow blower to deconstruct or dislodge snowbanks is fundamentally unsafe, regardless of how well-developed an artificial intelligence system may be. Accordingly, embodiments of the present disclosure may allow for safe snowbank deconstruction using an intentionally dulled motorized instrument that is configured to make repetitive, low-impact contact with accumulated snow. In this manner, a snowbank deconstructing system may be utilized by humans and autonomous vehicles to safely remove accumulated snow.

Figure 1:
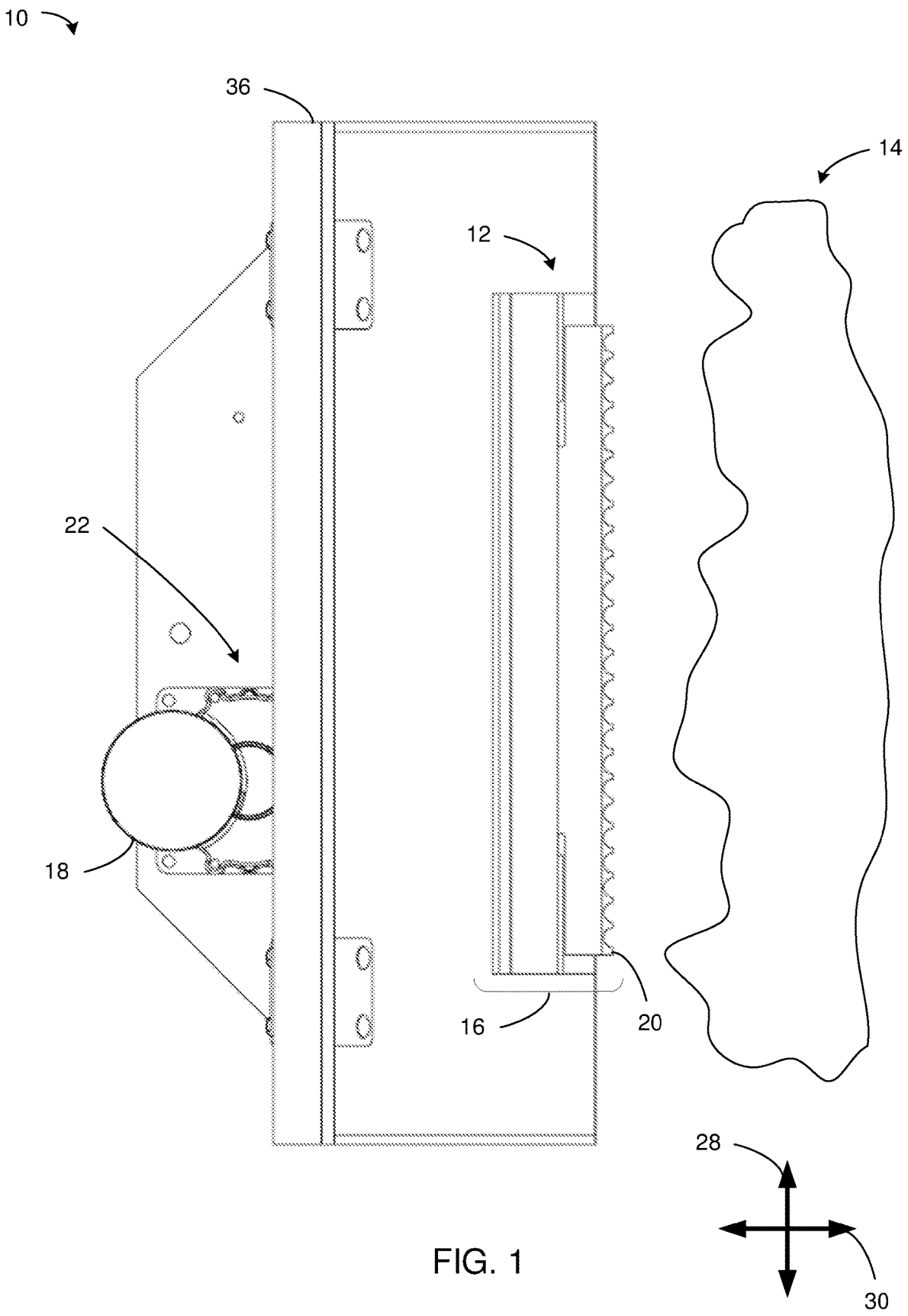
FIG. 1 is a top view of a snowbank deconstructing system according to an example embodiment.

Referring to the example of FIG. 1 and in some embodiments, a snowbank deconstructing system (e.g., snowbank deconstructing system 10) may include a dulled motorized instrument (e.g., dulled motorized instrument 12) configured to make repetitive, low-impact contact with accumulated snow (e.g., accumulated snow 14). While reference will primarily be made to deconstructing snowbanks or other accumulated snow formations, it will be appreciated that snowbank deconstructing system 10 may be configured to safely deconstruct any accumulated debris (e.g., dirt, sand, snow, etc.) within the scope of the present disclosure.

In some embodiments, dulled motorized instrument 12 may be dulled during and/or at the time of manufacture. For example and as will be described in greater detail below, dulled motorized instrument 12 may have one or more exposed portions that are configured to make contact with at least a portion of accumulated snow. As these exposed portions may be accessible to humans, dulled motorized instrument 12 may be configured to be safe to human touch during the repetitive, low-impact contact with the accumulated snow. As will be described in greater detail below, dulled motorized instrument 12 may include a dulled portion or portions that are configured to make repetitive, low-impact contact with accumulated snow that, if exposed to human touch, is non-lethal or minimally harmful.

In some embodiments, dulled motorized instrument 12 may be configured to be actuated or operated with one or more motors (e.g., electrical motors, hydraulic motors, pneumatic motors, etc.). In this manner, dulled motorized instrument 12 may be motorized by the combination of a dulled instrument and one or more motors configured to actuate or operate the dulled instrument. In some embodiments, dulled motorized instrument 12 may be a dulled electromechanical instrument with a combination of electrical components and mechanical components (i.e., an electromechanical instrument formed from electrical components and mechanical components). For example, dulled motorized instrument 12 may include one or more mechanical components (e.g., mechanical components 16) coupled to one or more electrical components (e.g., electrical component 18). In some embodiments, the one or more mechanical components may generally include a dulled portion (e.g., dulled portion 20) configured to make repetitive, low-impact contact with accumulated snow (e.g., accumulated snow 14) and linking portions (e.g., linkage 22) configured to couple the dulled portion to the electrical components. Examples of the dulled portion will be described in greater detail below.

In some embodiments, the one or more electrical components may generally include an electrical motor configured to drive a belt or chain or other linkage (e.g., linkage 22) to dulled portion 20. For example, electrical component 18 may be configured to actuate mechanical components 16 such that dulled portion 20 makes repetitive, low-impact contact with accumulated snow 14. In this manner, the combination of mechanical components 16 (e.g., dulled portion 20 and linkage 22) and electrical component 18 (e.g., an electrical motor) may allow snowbank deconstructing system 10 to make repetitive, low-impact contact with accumulated snow 14 in a manner that is safe to human touch. While examples of a dulled portion and an electrical motor have been discussed for the mechanical components and the electrical components, respectively, it will be appreciated that various other mechanical components and/or other electrical components may be used within the scope of the present disclosure.

In some embodiments, dulled motorized instrument 12 may be configured to be electrically coupled to a power source and/or electronic controls. For example, suppose snowbank deconstructing system 10 is coupled to e.g., a vehicle. In this example, dulled motorized instrument 12 may be configured to be electrically coupled to a power source (e.g., a power source specific to and/or integrated into snowbank deconstructing system 10 and/or a power source of the vehicle to which snowbank deconstructing system 10 is coupled). Additionally, dulled motorized instrument 12 may be configured to be electrically coupled to electronic controls of the vehicle to control the operation of dulled motorized instrument 12. For example, dulled motorized instrument 12 may be configured for various operating speeds and/or the amount of power delivered to movement of dulled portion 20. As discussed above and in some embodiments, dulled motorized instrument 12 may be configured to operate at limited speeds and/or with limited power to facilitate repetitive, low-impact contact with accumulated snow 14 with minimal harm to humans that may come in contact with dulled motorized instrument 12. Accordingly, it will be appreciated that dulled motorized instrument 12 may be configured to operate at various speeds and/or with various settings to deconstruct accumulated snow with minimal risk to humans.

Figure 2:
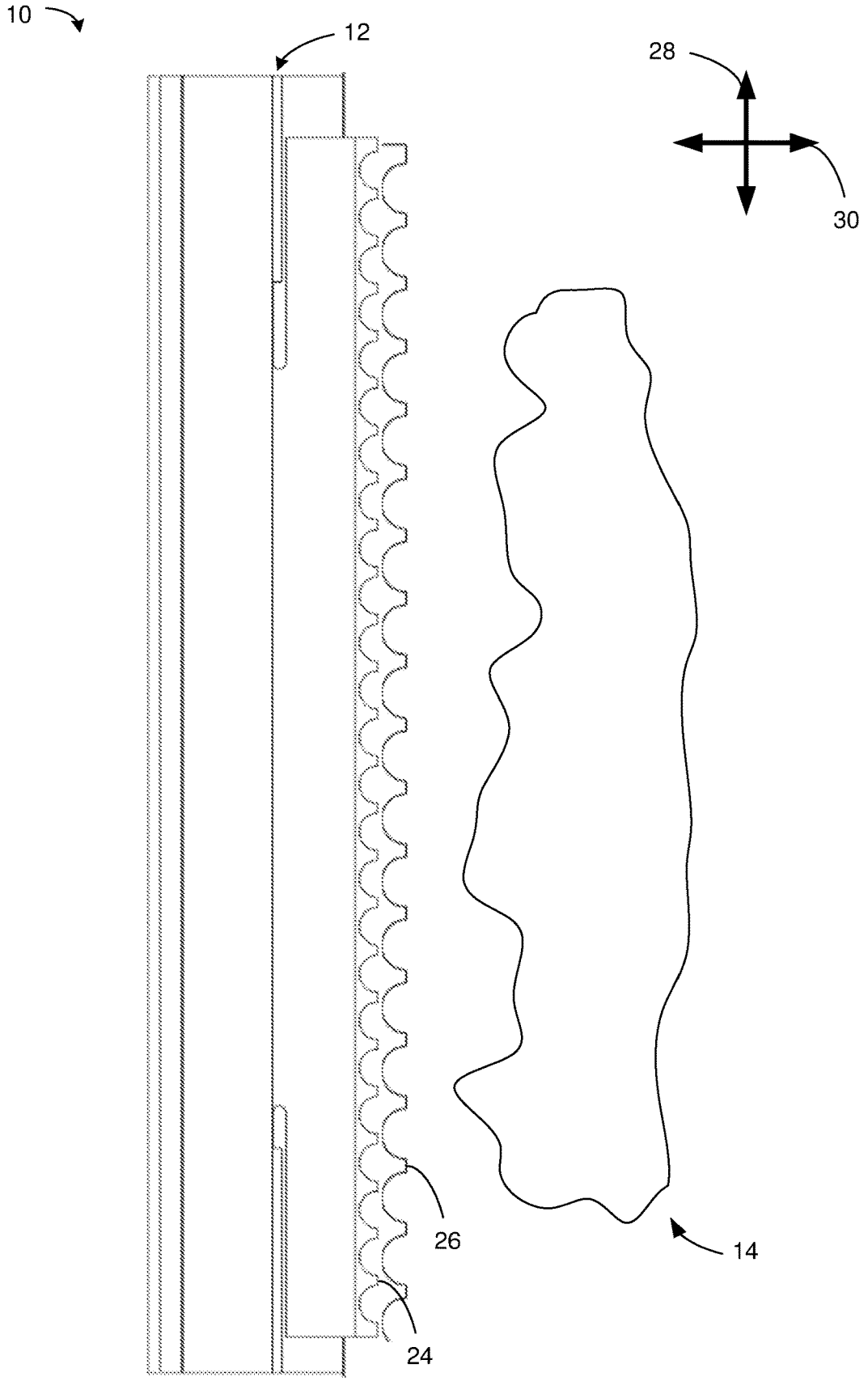
FIG. 2 is a top view of a dulled motorized instrument of a snowbank deconstructing system according to an example embodiment.

Referring also to the example of FIG. 2 and in some embodiments, the dulled motorized instrument may include a first dulled blade configured to reciprocate with respect to a second dulled blade. For example, dulled motorized instrument 12 may include a first dulled blade (e.g., first dulled blade 24) and a second dulled blade (e.g., second dulled blade 26). In some embodiments, first dulled blade 24 may be configured to reciprocate with respect to second dulled blade 26. In this example, first dulled blade 24 may be coupled to (e.g., via a mechanical linkage) electrical component 18 while second dulled blade may be configured to be stationary. However, it will be appreciated that both first dulled blade 24 and second dulled blade 26 may be coupled to electrical components such that each dulled blade may reciprocate with respect to the other blade. While an example of e.g., two dulled blades has been described, it will be appreciated that any number of dulled blades may be utilized within the scope of the present disclosure.

Figure 3:
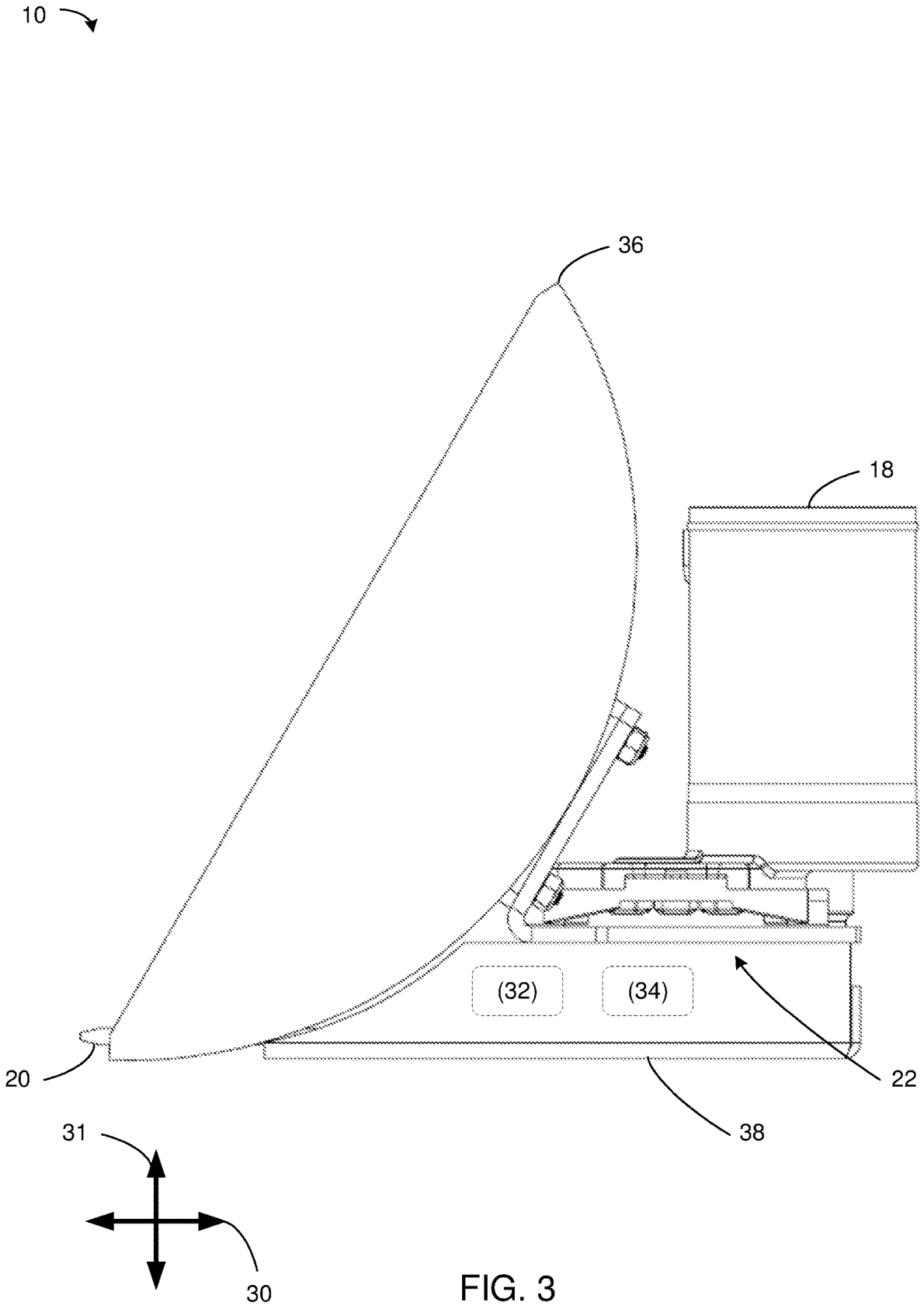
FIG. 3 is a side view of a snowbank deconstructing system according to an example embodiment.

Referring also to FIGS. 2-3 and in some embodiments, first dulled blade 24 may be configured to reciprocate laterally (e.g., in the direction of and/or along axis 28 as shown in FIG. 2), longitudinally (e.g., in the direction of and/or along axis 30 as shown in FIG. 2), and/or vertically (e.g., in the direction of and/or along axis 31 as shown in FIG. 3). However, it will be appreciated that first blade 24 may be configured to reciprocate in any direction or combination of directions within the scope of the present disclosure. In some embodiments, as first dulled blade 24 is reciprocated with respect to second dulled blade 26, the combination of first dulled blade 24 and second dulled blade 26 may shear or cut away snow from accumulated snow 14. As these blades are intentionally dulled, dulled motorized instrument 12 may repetitively make low-impact contact with accumulated snow 14 to deconstruct accumulated snow 14 in a manner that is safe for human exposure. While first dulled blade 24 and second dulled blade 26 are shown with dulled sets of "teeth" (i.e., sequences of protrusions and gaps within each dulled blade), it will be appreciated that first dulled blade 24 and/or second dulled blade 26 may be formed with or without "teeth" or other edge formations within the scope of the present disclosure. For example, in one embodiment, first dulled blade 24 and/or second dulled blade 26 may each have dulled, tapered or flat edges without any surface formations. Accordingly, it will be appreciated that various types of edge formations may be used for dulled motorized instrument 12 within the scope of the present disclosure.

In some embodiments, the dulled motorized instrument may include a dulled saw. Referring again to the example of FIG. 1 and in some embodiments, dulled motorized instrument 12 may include a dulled saw (e.g., dulled saw 20). In this example, dulled portion 20 may be a dulled saw. As discussed above and in some embodiments, dulled saw 20 may be intentionally dulled (e.g., at the time of manufacture). In some embodiments, dulled portion or saw 20 may include a reciprocating saw, a circular saw, a chainsaw, a band saw, a wire saw, a cable saw, or any other type of saw. As is known in the art, a saw generally includes a tough blade, wire, chain, etc. with a hard toothed edge configured for cutting or shearing a material by applying the toothed edge against the surface of the material. In the example of FIG. 1, dulled saw 20 is shown as a straight edge reciprocating saw with a limited reciprocation distance. For example, dulled saw 20 may be configured to reciprocate along axis 28. However, it will be appreciated that dulled saw 20 may be configured to reciprocate or operate in any direction or in any combination of directions. For example, and referring also to FIG. 3, dulled saw 20 may be configured to reciprocate along axis 28 of FIG. 2, axis 30 of FIG. 3, and/or axis 31 of FIG. 3. In another embodiment, dulled saw 20 may be e.g., a dulled circular saw configured to spin at low speeds and/or with low power such that dulled saw 20 is safe to human touch. Accordingly, it will be appreciated that dulled saw 20 may be operated (e.g., with low-impact, low power, etc.) such that, if exposed to human touch, any contact results in minor scrapes or cuts. In this manner, accidental human contact with dulled saw 20 may be non-lethal as to allow a human to safely withdraw from any contact with dulled saw 20 without loss of life or limb.

Referring again to the example of FIG. 3 and in some embodiments, dulled motorized instrument 12 may include a vibrating component. For example, dulled portion 20 may be configured to reciprocate or vibrate quickly across a limited distance and/or within a limited range of motion. In one example, dulled portion 20 may be driven by a piezoelectric motor to vibrate against accumulated snow. In some implementations and as discussed above, dulled portion 20 may include a dulled saw that is configured to vibrate while reciprocating. For example, electrical component 18 and linkage 22 may be configured to vibrate dulled portion 20. In this manner, dulled portion 20 may use the force applied while vibrating to safely dislodge material from a snowbank or other accumulated formation. In some embodiments, the vibrating component may be physically separate from dulled portion 20 and linkage 22 (e.g., vibrating component 32). For example, vibrating component 32 may be energized by electrical component 18 and may be configured to vibrate dulled portion 20.

Referring again to the example of FIG. 3 and in some embodiments, dulled motorized instrument 12 may include a heating component. For example, dulled portion 20 may be configured to be heated. In some embodiments, the temperature for heating dulled portion 20 may be controlled via electrical component 18 and/or other external controls. In some embodiments, the heating component (e.g., heating component 34) may be configured to heat at least a portion of dulled portion 20 and may be energized by electrical component 18. In some embodiments, the heating temperature may be limited to avoid burning skin during accidental human contact. For example, the heating temperature of dulled portion 20 may be limited to a threshold temperature. In one example, the threshold temperature may be 140° Fahrenheit (e.g., the temperature at which skin may be burned with three or more seconds of exposure). However, it will be appreciated that the threshold temperature for heating dulled portion 20 may be set to any value within the scope of the present disclosure. In this manner, snowbank deconstructing system 10 may utilize heating component 34 to heat dulled portion 20 to dislodge accumulated snow from a snowbank.

In some embodiments, snowbank deconstructing system 10 may include a shovel component. Referring again to the example of FIG. 3 and referring also to FIGS. 3-5, snowbank deconstructing system 10 may include a shovel component (e.g., shovel component 36). Shovel component 36 may generally include a scoop or other structure with a generally flat surface and at least partially upturned edges. While shovel component 36 is shown with a rounded bottom, it will be appreciated that shovel component 36 may be formed in any shape. For example and referring also to FIGS. 6A-6B, shovel component 36 may include any sized or shaped scoop. While several example configurations for shovel component have been shown and described, it will be appreciated that the shovel component may be any size or shape within the scope of the present disclosure. In some embodiments, shovel component 36 may be intentionally dulled to avoid or reduce harm during accidental human contact. Accordingly, the terms "shovel component" and "dulled shovel component" may be used interchangeably within the scope of the present disclosure.

Figure 4:
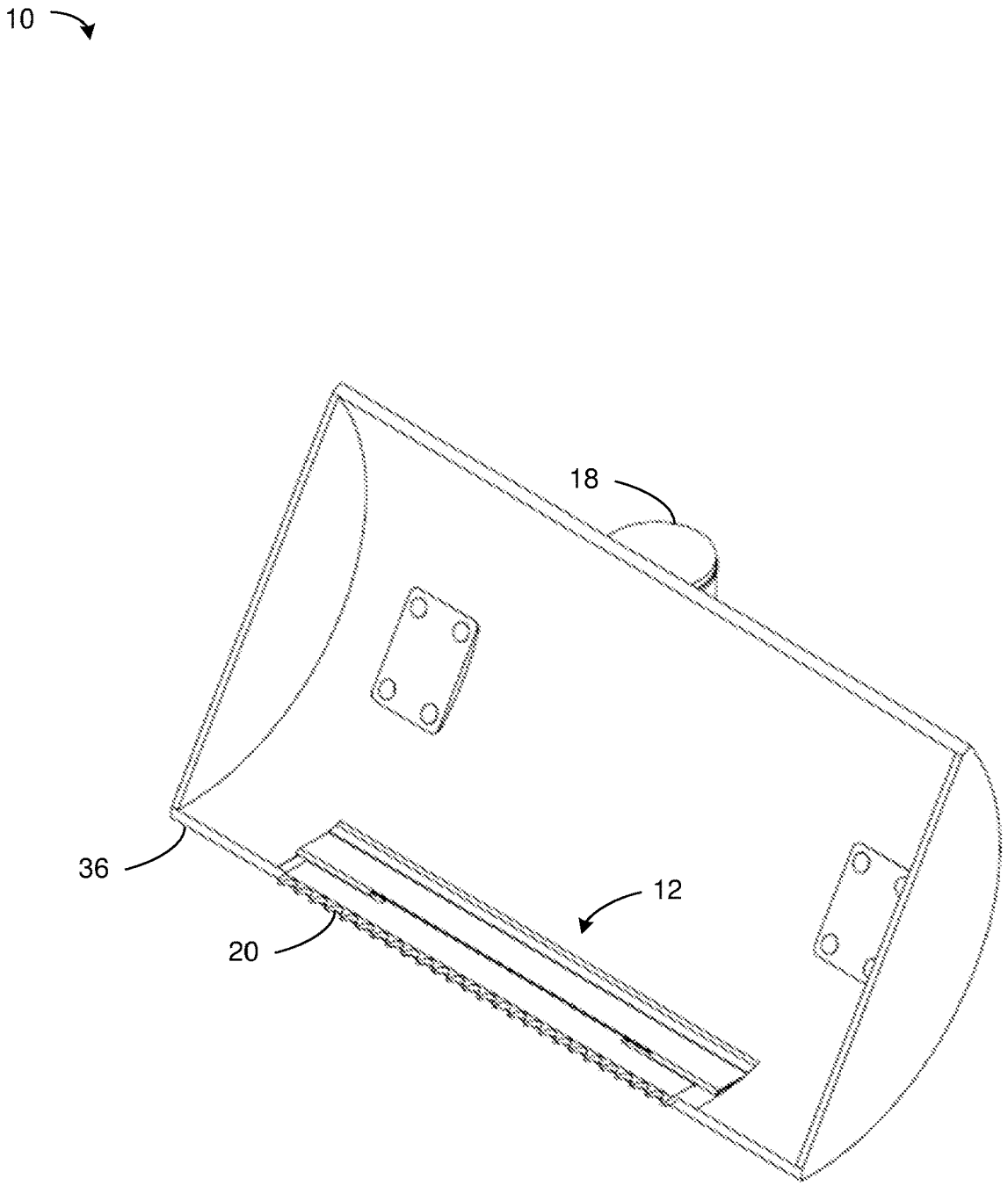
FIGS. 4-5 are perspective views of a snowbank deconstructing system according to an example embodiment.
Figure 5:
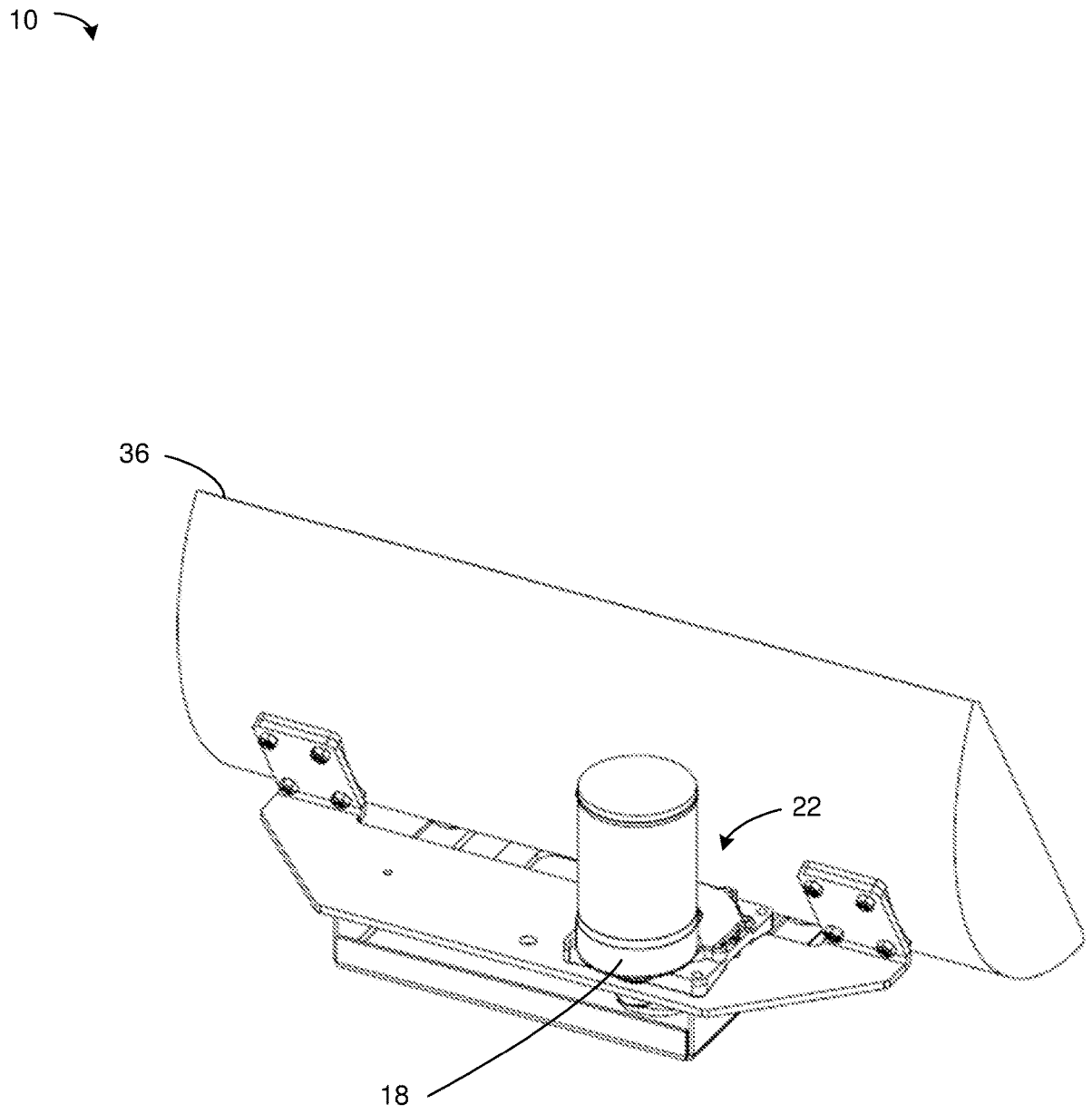
Figure 6A:
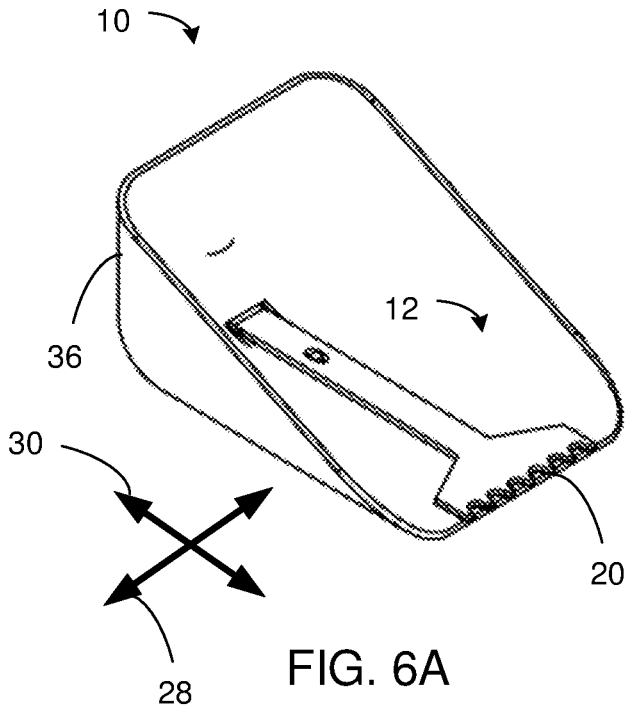
FIGS. 6A-6B are perspective views of a shovel component of a snowbank deconstructing system according to an example embodiment.
Figure 6B:
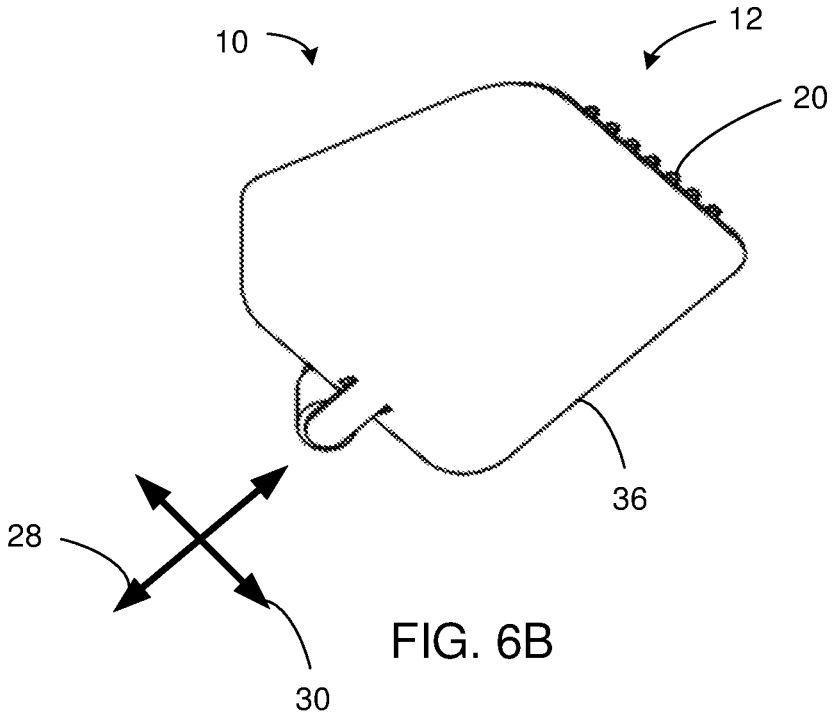

In some embodiments, dulled motorized instrument 12 may be configured to be coupled to and/or integrated into shovel component 36. For example and as shown in FIGS. 3-4, dulled motorized instrument 12 may be built into shovel component 36. In some embodiments, dulled motorized instrument 12 may be positioned within or on shovel component 36 with dulled portion 20 extending over or along an edge of shovel component 36. For example, dulled portion 20 may be configured to extend along the bottom edge of shovel component 36 (i.e., the edge configured to lead shovel component 36 during scooping of snow or other material(s)).

Referring again to the example of FIG. 3 and in some embodiments, shovel component 36 may include a base portion (e.g., base portion 38) configured to orient shovel component 36 at a particular angle. For example, base portion 38 may be configured to orient shovel component 36 at any angle ranging from 0° to 90° relative to the ground (e.g., relative to axis 30). In some embodiments, the angle between base portion 38 and shovel component 36 may be adjustable. In some embodiments, the angle between base portion 38 and shovel component 36 may be fixed at a predefined angle. In some embodiments, electrical component 18 and linkage 22 may be positioned within and/or on base portion 38 behind shovel component 36. In this manner, electrical component 18 and linkage 22 may be isolated from contact with accumulated snow 14. However, it will be appreciated that electrical component 18 and/or linkage 22 may be positioned anywhere within or on shovel component 36 within the scope of the present disclosure.

In some embodiments, the dulled saw may be configured to actuate along at least one of a lateral axis and a longitudinal axis of the shovel component. Referring again to the example of FIG. 1 and in some embodiments, dulled saw 20 may be configured to actuate or reciprocate along a lateral axis of shovel component 36 (e.g., along axis 28) and/or along a longitudinal axis of shovel component 36 (e.g., along axis 30). In this manner, dulled saw 20 may be configured to repetitively saw against accumulated snow 14. As discussed above, the repetitive reciprocation of dulled saw along axis 28 and/or along axis 30 may be low-impact to avoid injury during accidental human contact.

In some embodiments and as discussed above, dulled motorized instrument 12 may be configured for repetitive, low-impact contact with accumulated snow 14. For example and referring again to FIG. 1, snowbank deconstructing system 10 may be positioned adjacent to accumulated snow 14 (e.g., a snowbank). Snowbank deconstructing system may be positioned such that dulled motorized instrument 12 is in contact with accumulated snow 14. In some embodiments, dulled motorized instrument 12 may be energized such that at least a portion of dulled motorized instrument 12 makes repetitive, low-impact contact with accumulated snow 14.

Figure 7:
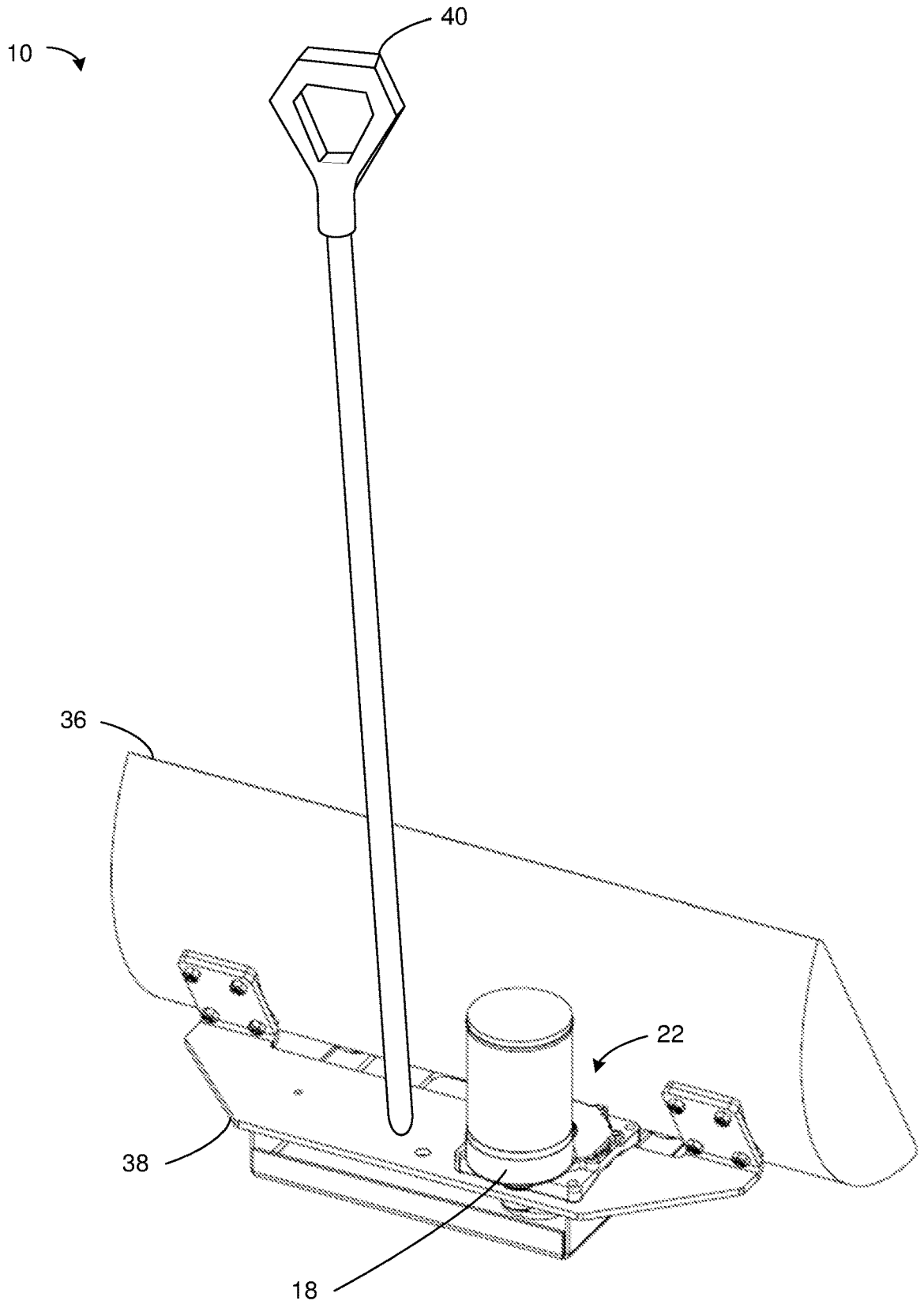
FIG. 7 is a perspective view of a snowbank deconstructing system according to an example embodiment.

Referring also to the example of FIG. 7 and in some embodiments, dulled motorized instrument 12 may be configured to be coupled to a handle (e.g., handle 40). In this example, dulled motorized instrument 12 may be coupled to one end of a pole or post while handle 40 may be coupled to the opposite end. In this manner, snowbank deconstructing system 10 may be configured to be operated by a person in a similar manner as a snow shovel. While an example with e.g., a single pole and a single handle has been shown and described, it will be appreciated that dulled motorized instrument 12 may be coupled to various handles and/or pole structures to allow a person to operate snowbank deconstructing system 10 by hand.

In some embodiments, the dulled motorized instrument may be configured to be coupled to a vehicle. For example, dulled motorized instrument 12 may be configured to be coupled to a vehicle. In some embodiments, dulled motorized instrument 12 may be coupled to and/or integrated into any type of vehicle (e.g., a tractor, a truck, etc.) within the scope of the present disclosure. For example, dulled motorized instrument 12 may be coupled to an exterior edge of a vehicle; allowing the vehicle to safely deconstruct accumulated snow 14 and/or other materials (e.g., dirt, sand, etc.). As will be discussed in greater detail below, dulled motorized instrument 12 may be integrated into an autonomous vehicle to form an autonomous snowbank deconstructing vehicle.

Referring again to FIGS. 1-13B, an autonomous snowbank deconstructing system (e.g., autonomous snowbank deconstructing system 100) may include an autonomous vehicle (e.g., autonomous vehicle 102) and a dulled motorized instrument (e.g., dulled motorized instrument 12) coupled to the autonomous vehicle and configured to make repetitive, low-impact contact with accumulated snow.

Figure 8:
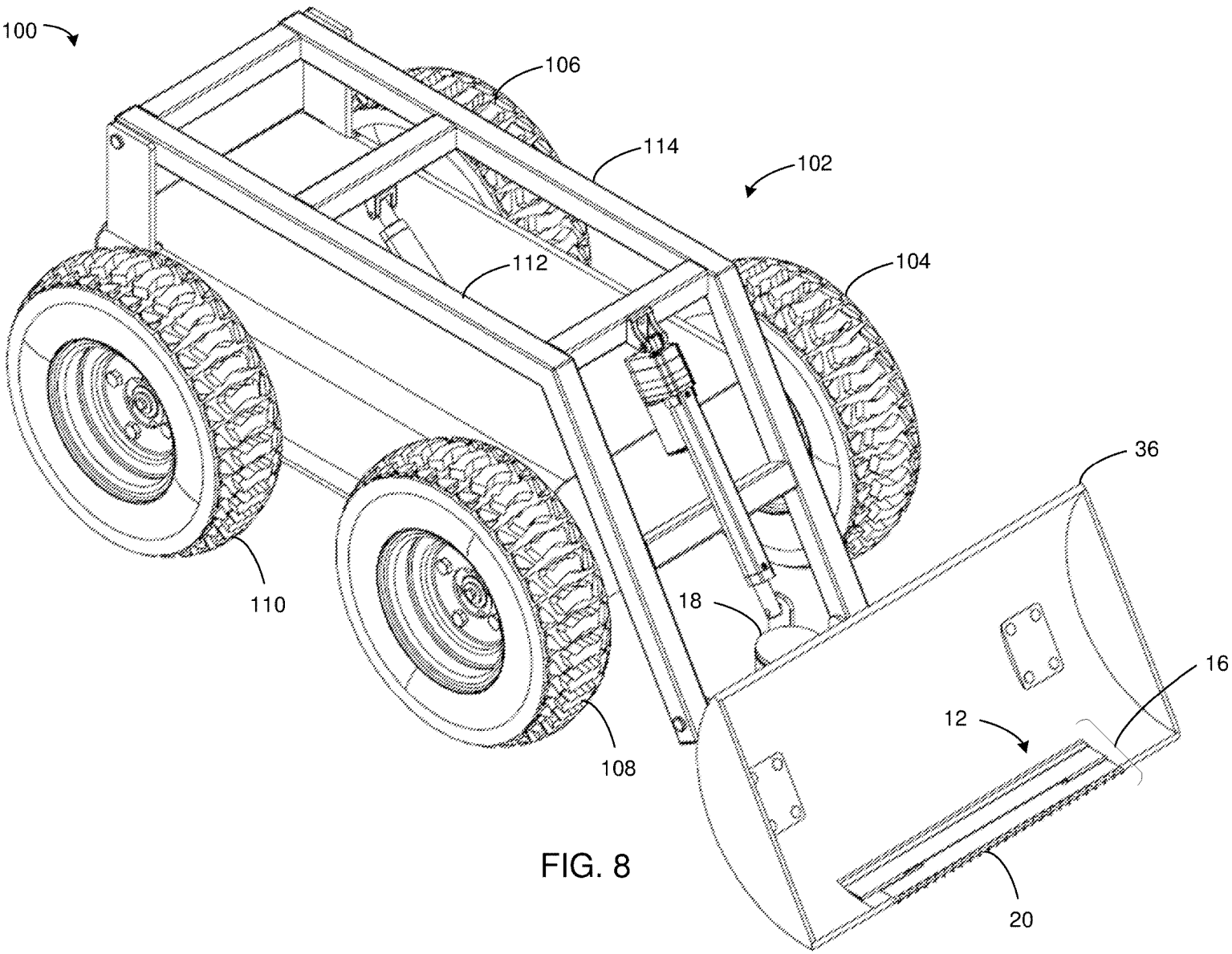
FIGS. 8-13B are perspective views of autonomous snowbank deconstructing vehicles according to various example embodiments.

Referring also to FIG. 8 and in some embodiments, autonomous vehicle 102 may generally include a vehicle that is capable of sensing its environment and moving safely with little or no human input. As is known in the art, autonomous vehicles may include various sensors, sensor arrays, and artificial intelligence algorithms operating on one or more computing devices to navigate a particular environment. In some embodiments, autonomous vehicles may be programmed to perform one or more functions or tasks. As will be discussed in greater detail below, autonomous vehicle 102 may be coupled to dulled motorized instrument 12 to allow autonomous vehicle 102 to safely deconstruct accumulated snow formations.

In some embodiments, autonomous vehicle 102 may include a plurality of wheels (e.g., wheels 104, 106, 108, 110) and a drivetrain configured to drive autonomous vehicle 102. It will be appreciated that while an example of autonomous vehicle 102 has been provided with e.g., four wheels (e.g., wheels 104, 106, 108, 110), autonomous vehicle 102 may include any number of wheels, legs, tracks, or any other devices configured to allow autonomous vehicle 102 to move. As is known in the art, various motors, pneumatics, hydraulics, etc. may be employed to drive autonomous vehicle 102. For example, autonomous vehicle 102 may include one or more rechargeable batteries configured to drive one or more motors and sensors that allow autonomous vehicle to operate and move within a particular environment. While an example of rechargeable batteries has been provided, it will be appreciated that autonomous vehicle 102 may utilize any power source to energize components of autonomous vehicle 102.

In some embodiments, dulled motorized instrument 12 may include a first dulled blade configured to reciprocate with respect to a second dulled blade. Referring again to the example of FIG. 2, dulled motorized instrument 12 may include a first dulled blade (e.g., first dulled blade 24) and a second dulled blade (e.g., second dulled blade 26). In some embodiments, first dulled blade 24 may be configured to reciprocate with respect to second dulled blade 26. In this example, first dulled blade 24 may be coupled to (e.g., via a mechanical linkage) electrical component 18 while second dulled blade is configured to be stationary. However, it will be appreciated that both first dulled blade 24 and second dulled blade 26 may be coupled to electrical components such that each dulled blade may reciprocate with respect to other blade. While an example of e.g., two dulled blades has been described, it will be appreciated that any number of dulled blades may be utilized within the scope of the present disclosure.

In some embodiments, first dulled blade 24 may be configured to reciprocate laterally (e.g., in the direction of and/or along the axis 28 as shown in FIG. 2) and/or longitudinally (e.g., in the direction of and/or along the axis 30 as shown in FIG. 2). In some embodiments, as first dulled blade 24 is reciprocated with respect to second dulled blade 26, the combination of first dulled blade 24 and second dulled blade 26 may shear or cut away snow from accumulated snow 14. As these blades are dull, dulled motorized instrument 12 may repetitively make low-impact contact with accumulated snow 14 to deconstruct accumulated snow 14 in a manner that is safe for human exposure. While first dulled blade 24 and second dulled blade 26 are shown with dulled sets of "teeth" (i.e., sequence of protrusions and gaps within each dulled blade), it will be appreciated that first dulled blade 24 and/or second dulled blade 26 may be formed with or without "teeth" or other edge formations within the scope of the present disclosure. For example, in one embodiment, first dulled blade 24 and/or second dulled blade 26 may each have dulled, tapered or flat edges without any surface formations. Accordingly, it will be appreciated that various types of edge formations may be used for dulled motorized instrument 12 within the scope of the present disclosure.

In some embodiments, the dulled motorized instrument may include a dulled saw. Referring again to the example of FIG. 1 and in some embodiments, dulled motorized instrument 12 may include a dulled saw (e.g., dulled saw 20). In this example, dulled portion 20 may be a dulled saw. In some embodiments, dulled portion or saw 20 may include a reciprocating saw, a circular saw, a chainsaw, a band saw, a wire saw, a cable saw, or any other type of saw. As is known in the art, a saw generally includes a tough blade, wire, chain, etc. with a hard toothed edge configured for cutting or shearing a material by applying the toothed edge against the surface of the material. In the example of FIG. 1, dulled saw 20 is shown as a straight edge reciprocating saw with a limited reciprocation distance. For example, dulled saw 20 may be configured to reciprocate along axis 28. However, it will be appreciated that dulled saw 20 may be configured to reciprocate or operate in any direction. For example, in another embodiment, dulled saw 20 may be e.g., a dulled circular saw configured to spin at low speeds and/or with low power such that dulled saw 20 is safe to human touch. Accordingly, it will be appreciated that dulled saw 20 may be operated (e.g., low-impact, low power, etc.) such that, if exposed to human touch, any contact results in minor scrapes or cuts. In this manner, accidental human contact with dulled saw 20 may be non-lethal as to allow a human to safely withdraw from any contact with dulled saw 20 without loss of life or limb.

Referring also to the example of FIG. 3 and in some embodiments, dulled motorized instrument 12 may include a vibrating component. For example, dulled portion 20 may be configured to reciprocate or vibrate quickly across a limited distance and/or within a limited range of motion. In one example, dulled portion 20 may be driven by a piezoelectric motor to vibrate against accumulated snow. In some implementations and as discussed above, dulled portion 20 may include a dulled saw that is configured to vibrate while reciprocating. For example, electrical component 18 and linkage 22 may be configured to vibrate dulled portion 20. In this manner, dulled portion 20 may use the force applied while vibrating to safely dislodge material from a snowbank or other accumulated formation. In some embodiments, the vibrating component may be physically separate from dulled portion 20 and linkage 22 (e.g., vibrating component 32). For example, vibrating component 32 may be energized by electrical component 18 and may be configured to vibrate dulled portion 20.

Referring again to the example of FIG. 3 and in some embodiments, dulled motorized instrument 12 may include a heating component. For example, dulled portion 20 may be configured to be heated. In some embodiments, the temperature for heating dulled portion 20 may be controlled via electrical component 18 and/or other external controls. In some embodiments, the heating component (e.g., heating component 34) may be configured to heat at least a portion of dulled portion 20 and may be energized by electrical component 18. In some embodiments, the heating temperature may be limited to avoid burning skin during contact with a human. For example, the heating temperature of dulled portion 20 may be limited to a threshold temperature. In one example, the threshold temperature may be 140° Fahrenheit (e.g., the temperature at which skin may be burned with three or more seconds of exposure). However, it will be appreciated that the threshold temperature for heating dulled portion 20 may be set to any value within the scope of the present disclosure. In this manner, autonomous snowbank deconstructing system 100 may utilize heating component 34 to heat dulled portion 20 to dislodge accumulated snow from a snowbank.

In some embodiments, autonomous snowbank deconstructing system 100 may include a shovel component (e.g., shovel component 36) coupled to autonomous vehicle 102. As discussed above and in some embodiments, shovel component 36 may generally include a scoop or other structure with a generally flat surface and at least partially upturned edges. While shovel component 36 is shown with a rounded bottom, it will be appreciated that shovel component 36 may be formed in any shape. For example and referring again to FIGS. 6A-6B, shovel component 36 may include any sized or shaped scoop. While several example configurations for shovel component have been shown and described, it will be appreciated that the shovel component may be any size or shape within the scope of the present disclosure. As will be discussed in greater detail below, shovel component 36 may be coupled to autonomous vehicle 102 via one or more boom arms.

In some embodiments, dulled motorized instrument 12 may be configured to be coupled to and/or integrated into shovel component 36. For example and as shown in FIG. 8, dulled motorized instrument 12 may be built into shovel component 36. In some embodiments, dulled motorized instrument 12 may be positioned within or on shovel component 36 with dulled portion 20 extending over or along an edge of shovel component 36. For example, dulled portion 20 may be configured to extend along the bottom edge of shovel component 36 (i.e., the edge configured to lead shovel component 36 during scooping of snow or other material(s) by autonomous snowbank deconstructing system 100).

Referring again to the example of FIG. 3 and in some embodiments, shovel component 36 may include a base portion (e.g., base portion 38) configured to orient shovel component 36 at a particular angle. For example, base portion 38 may be configured to orient shovel component 36 at any angle ranging from 0° to 90° relative to the ground. In some embodiments, the angle between base portion 38 and shovel component 36 may be adjustable. In some embodiments, the angle between base portion 38 and shovel component 36 may be fixed at a predefined angle. In some embodiments, electrical component 18 and linkage 22 may be positioned within and/or on base portion 38 behind shovel component 36. In this manner, electrical component 18 and linkage 22 may be isolated from contact with accumulated snow 14. However, it will be appreciated that electrical component 18 and/or linkage 22 may be positioned anywhere within or on shovel component 36 within the scope of the present disclosure.

In some embodiments, the dulled saw may be configured to actuate along at least one of a lateral axis and a longitudinal axis of the shovel component. Referring again to the examples of FIGS. 1-3 and in some embodiments, dulled saw 20 may be configured to actuate or reciprocate along a lateral axis of shovel component 36 (e.g., along axis 28) and/or along a longitudinal axis of shovel component 36

(e.g., along axis 30), and/or vertically (e.g., in the direction of and/or along axis 31 as shown in FIG. 3). However, it will be appreciated that dulled saw 20 may be configured to reciprocate in any direction or combination of directions within the scope of the present disclosure. In this manner, dulled saw 20 may be configured to repetitively saw against accumulated snow 14. As discussed above, the repetitive reciprocation of dulled saw along axis 28 and/or along axis 30 and/or along axis 31 may be low-impact to avoid injuring accidental contact with a human.

Figure 9:
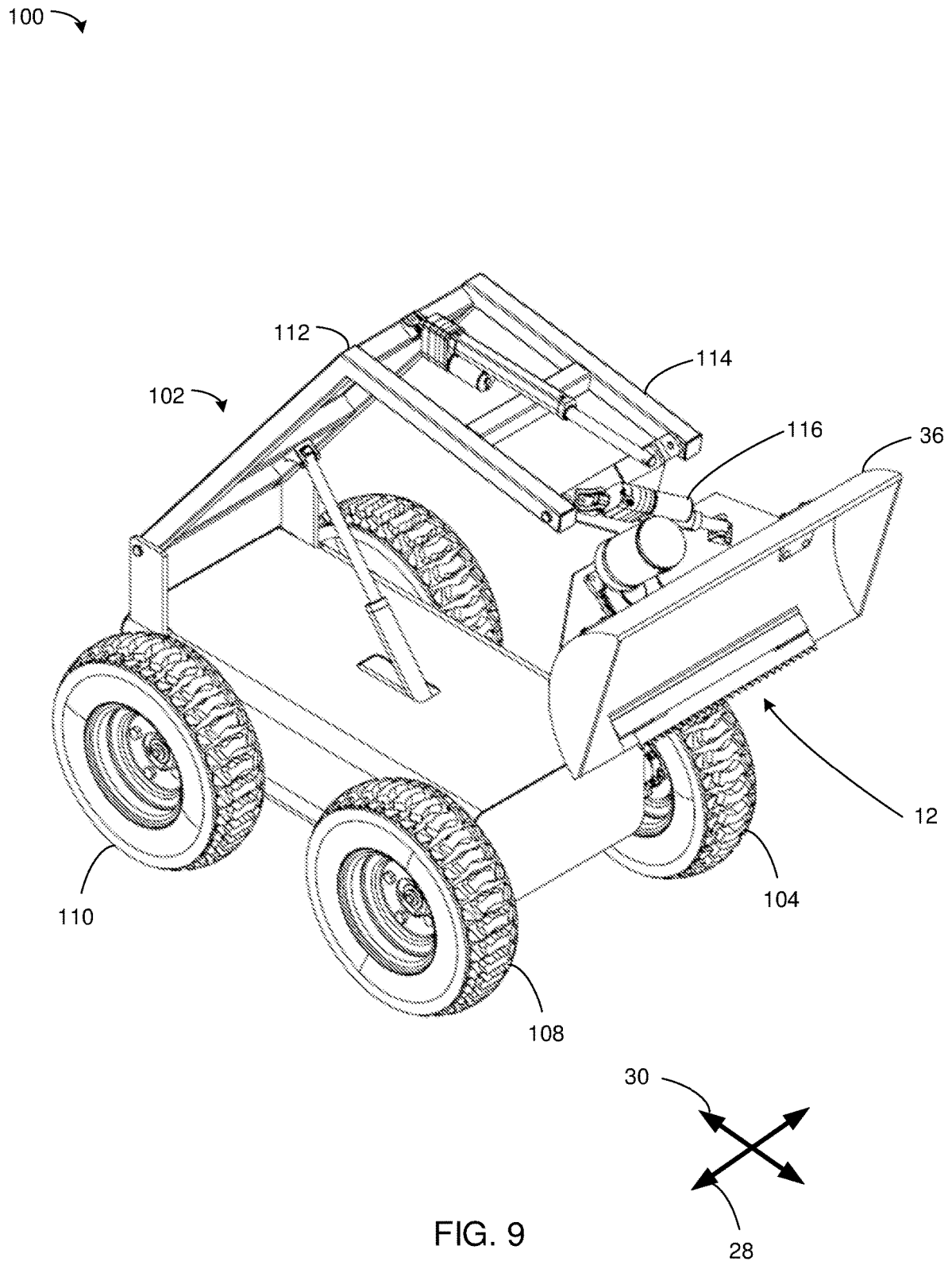

In some embodiments, autonomous snowbank deconstructing system 100 may include one or more boom arms. Referring now to FIGS. 8-9 and in some embodiments, autonomous snowbank deconstructing system 100 may include one or more boom arms (e.g., boom arms 112, 114). As is known in the art, a boom arm may generally include a mechanical arm configured to position an object in a particular orientation. In some embodiments, autonomous vehicle 102 may include various motors, hydraulics, pneumatics, etc. to manipulate boom arms 112, 114. For example, autonomous snowbank deconstructing system 100 may include one or more boom arms (e.g., boom arms 112, 114) that are configured to position one or more portions of autonomous snowbank deconstructing system 100 in proximity to accumulated snow. While the example of FIG. 8 includes e.g., two boom arms, it will be appreciated that any number of boom arms may be coupled to autonomous vehicle 102 within the scope of the present disclosure. For example and referring also to FIG. 10, autonomous snowbank deconstructing system 100 may include a single boom arm (e.g., boom arm 112). However, it will be appreciated that any number or configuration of boom arms is within the scope of the present disclosure.

In one embodiment, dulled motorized instrument 12 may be coupled to boom arms 112, 114. As shown in the example of FIG. 8, dulled motorized instrument 12 may be coupled to boom arms 112, 114. In this manner, boom arms 112, 114 may be used to position dulled motorized instrument 12 against a snowbank to deconstruct or dislodge accumulated snow. While FIG. 8 shows dulled motorized instrument 12 coupled to shovel component 36, it will be appreciated that dulled motorized instrument 12 may be coupled directly to boom arms 112, 114, with or without shovel component 36, within the scope of the present disclosure.

In some embodiments, a shovel component may be coupled to autonomous snowbank deconstructing system 100 via one or more boom arms. Referring again to FIG. 8 and in some embodiments, shovel component 36 may be coupled to autonomous snowbank deconstructing system 100 via boom arms 112, 114. Boom arms 112, 114 may be positioned by autonomous snowbank deconstructing system 100 using various motors, pneumatics, hydraulics, etc. As will be discussed in greater detail below, autonomous snowbank deconstructing system 100 may be programmed and/or trained to autonomously perform discrete tasks using the combination of boom arms 112, 114; shovel component 36; and dulled motorized instrument 12.

In some embodiments, shovel component 36 may be coupled to boom arms 112, 114 via a rotatable hinge assembly. For example and referring again to FIG. 9, boom arms 112, 114 may include a rotatable hinge assembly (e.g., rotatable hinge assembly 116) that is configured to rotate shovel component 36 and/or dulled motorized instrument 12 horizontally (e.g., along axis 28). In some implementations, rotatable hinge assembly 116 may also be configured to rotate shovel component 36 and/or dulled motorized instrument 12 vertically. As discussed above and in some embodiments, boom arms 112, 114 may include various motors, pneumatics, hydraulics, etc. and corresponding control systems to control the rotation of shovel component 36 and/or dulled motorized instrument 12. While an example of e.g., one rotatable hinge assembly has been described, it will be appreciated that any number of rotatable hinge assemblies may be used within the scope of the present disclosure (e.g., a separate rotatable hinge assembly for each of shovel component 36 and dulled motorized instrument 12).

In some embodiments, the one or more boom arms may include one or more articulating boom arms. As is known in the art, an articulating boom may generally include a boom formed from one or more "joints" or connected sections that may be individually positioned with respect to one another (e.g., via various motors, pneumatics, hydraulics, etc.). In some embodiments, boom arms 112, 114 may include a plurality of sections coupled together and configured to be articulated via autonomous vehicle 102. As discussed above, autonomous vehicle 102 may be programmed to orient or position articulating boom arms 112, 114 based upon, at least in part, a particular task that autonomous vehicle 102 is programmed and/or trained to complete. For example and as will be discussed in greater detail below, autonomous snowbank deconstructing system 100 may be programmed and/or trained to utilize articulating boom arms 112, 114 to move snow or other debris (e.g., scooping and lifting material) and/or to deconstruct accumulated snow or other materials (e.g., positioning dulled motorized instrument 12 against accumulated snow to dislodge snow).

Figure 10:
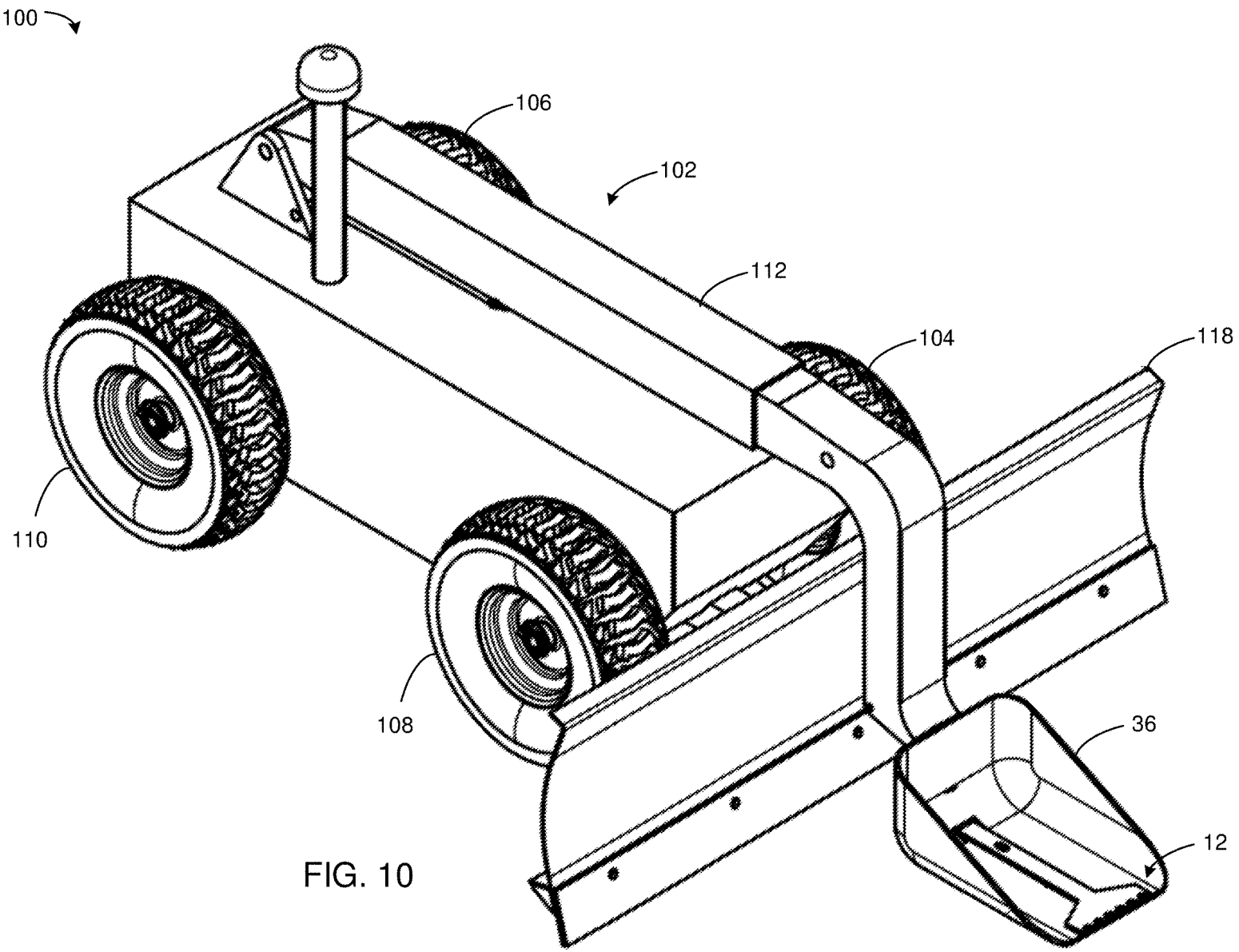

In some embodiments, the one or more boom arms may include one or more telescopic boom arms. As is known in the art, a telescopic boom may generally include a boom with one or more sections that are configured to extend telescopically. For example and as shown in the example of FIG. 10, boom arm 112 may be configured to extend telescopically. In some embodiments and as will be discussed in greater detail below, autonomous vehicle 102 may be programmed to orient or position telescoping boom arm 112 based upon, at least in part, a particular task that autonomous vehicle 102 is programmed and/or trained to complete. For example and as will be discussed in greater detail below, autonomous snowbank deconstructing system 100 may be programmed and/or trained to utilize telescoping boom arm 112 to move snow or other debris (e.g., scooping and lifting material) and/or to deconstruct accumulated snow or other materials (e.g., positioning dulled motorized instrument 12 against accumulated snow to dislodge snow). While the example of FIG. 10 includes e.g., a single telescoping boom arm (e.g., boom arm 12), it will be appreciated that autonomous snowbank deconstructing system 100 may include any number of telescoping boom arms within the scope of the present disclosure.

Figure 11:
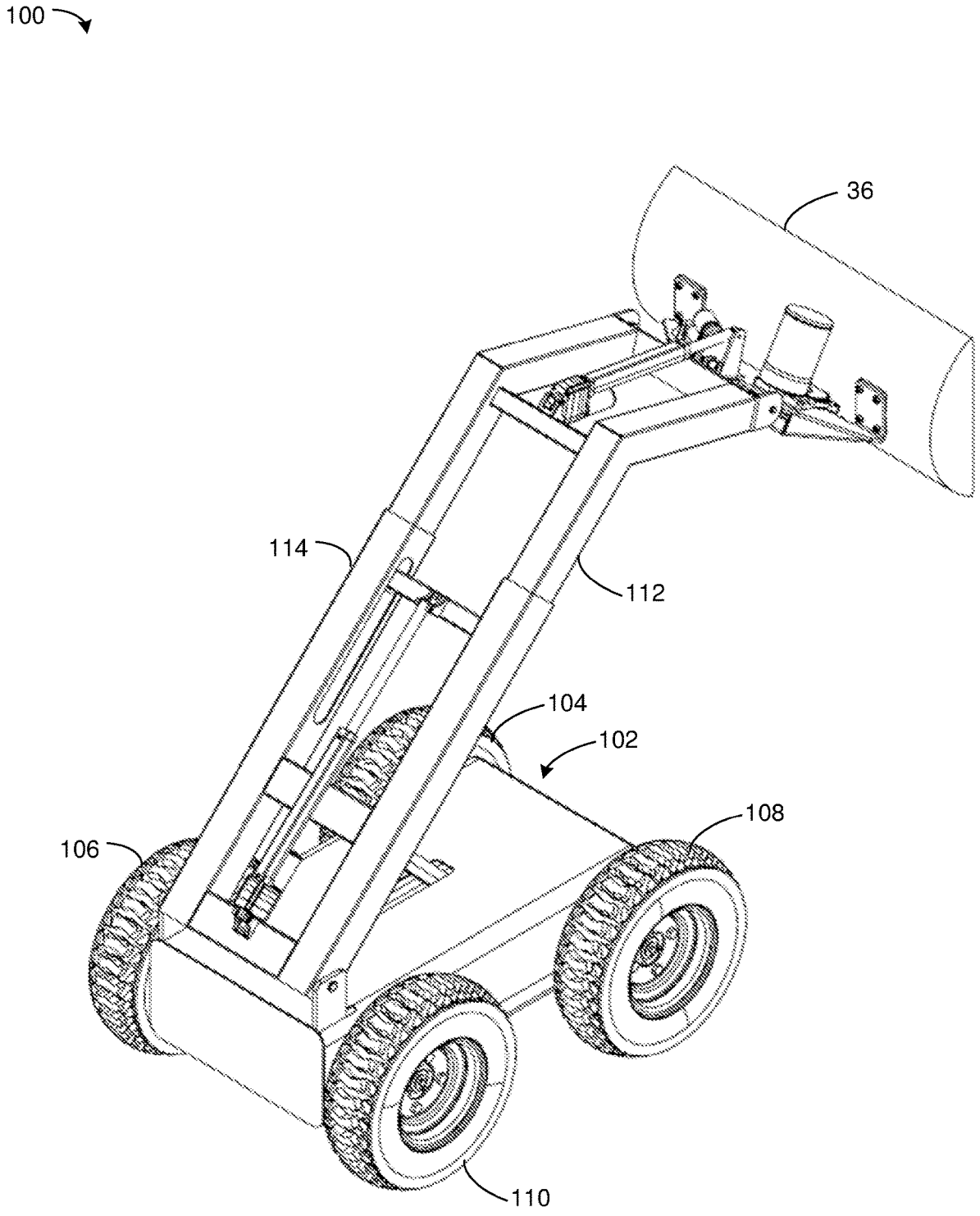
Figure 12:
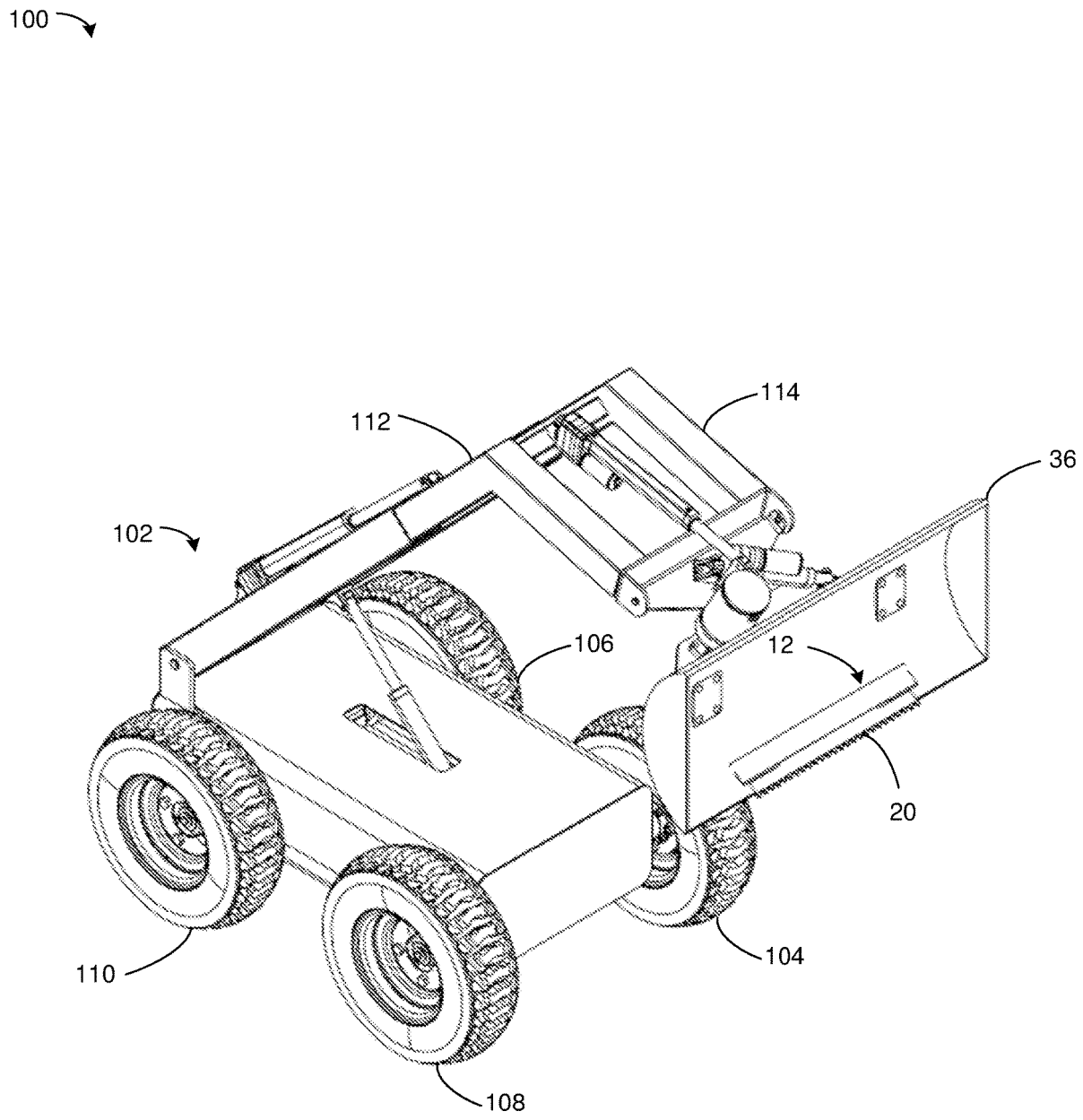

For example and referring also to FIGS. 11-12, autonomous snowbank deconstructing system 100 may include e.g., two telescoping boom arms (e.g., boom arms 112, 114). In some embodiments, autonomous vehicle 102 may be programmed to orient or position telescoping boom arms 112, 114 based upon, at least in part, a particular task that autonomous vehicle 102 is programmed and/or trained to complete. For example and as will be discussed in greater detail below, autonomous snowbank deconstructing system 100 may be programmed and/or trained to utilize telescoping boom arms 112, 114 to move snow or other debris (e.g., scooping and lifting material) and/or to deconstruct accumulated snow or other materials (e.g., positioning dulled motorized instrument 12 against accumulated snow to dislodge snow).

In some embodiments, autonomous snowbank deconstructing system 100 may be configured as a skid-steer loader. For example and referring again to FIG. 8, wheels 104, 106, 108, 110 may be mechanically locked in synchronization on each side. The left-side drive wheels (e.g., wheels 104, 106) may be driven independently of the right-side drive wheels (e.g., wheels 108, 110). In some embodiments, boom arms 112, 114 may be configured with pivot points at the end of the vehicle opposite shovel component 36 and/or dulled motorized instrument 12. In some embodiments, autonomous snowbank deconstructing system 100 may be configured for radial lift loading using pivot points at the end of autonomous vehicle 102 opposite to shovel component 36 and/or dulled motorized instrument 12 to pivot boom arms 112, 114 up in an arc that swings up and at least partially over the top of autonomous vehicle 102.

In some embodiments, autonomous snowbank deconstructing system 100 may be configured for vertical lift loading using multiple pivot points and parallel lifting bars on boom arms 112, 114, with the main pivot points towards the center or front of autonomous vehicle 102 (i.e., the end of autonomous vehicle adjacent to shovel component 36 and/or dulled motorized instrument 12). While two examples of lift loading configurations have been described, it will be appreciated that the one or more boom arms (e.g., boom arms 112, 114) may be positioned in any configuration within the scope of the present disclosure.

Referring again to the example of FIG. 10 and in some embodiments, autonomous snowbank deconstructing system 100 may include a fixed plow component (e.g., plow component 118) that is separate from shovel component 36. In this manner, autonomous snowbank deconstructing system 100 may be programmed and/or trained to move snow or other debris using plow component 118 and may use shovel component 36 and/or dulled motorized instrument 12 to deconstruct accumulated snow. In some embodiments, autonomous snowbank deconstructing system 100 may include one or more rotating brushes configured to move snow or other debris.

In some embodiments and as discussed above, the autonomous vehicle may be configured to move snow with the shovel component and deconstruct the accumulated snow with the dulled motorized instrument. For example, autonomous snowbank deconstructing system 100 may include (e.g., within autonomous vehicle 102) one or more computing devices and/or processors configured to receive sensor information from a plurality of sensors to move snow and/or other debris and to deconstruct accumulated snow. In some embodiments, autonomous snowbank deconstructing system 100 may be programmed with various artificial intelligence algorithms to process input sensor data to determine when and how to move portions of autonomous snowbank deconstructing system (e.g., autonomous vehicle 102, dulled motorized instrument 12, shovel component 36, and/or boom arms 112, 114) to move snow and/or deconstruct accumulated snow. As is known in the art, various artificial intelligence algorithms may be utilized to program or train an autonomous vehicle to perform particular tasks. Accordingly, any artificial intelligence algorithm(s) may be used to program or train autonomous snowbank deconstructing system 100 to move snow and/or deconstruct accumulated snow.

Figure 13A:
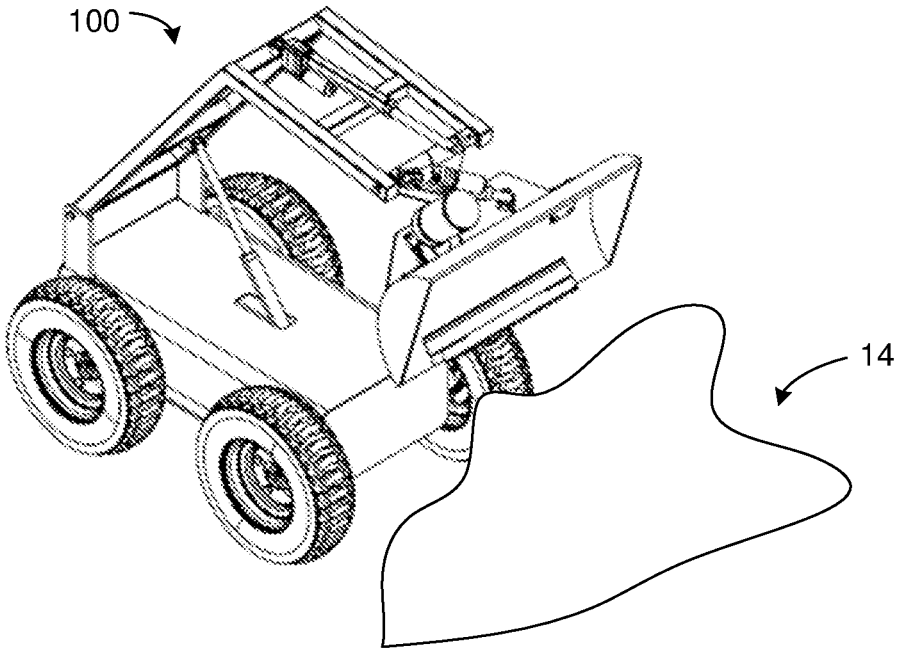
Figure 13B:
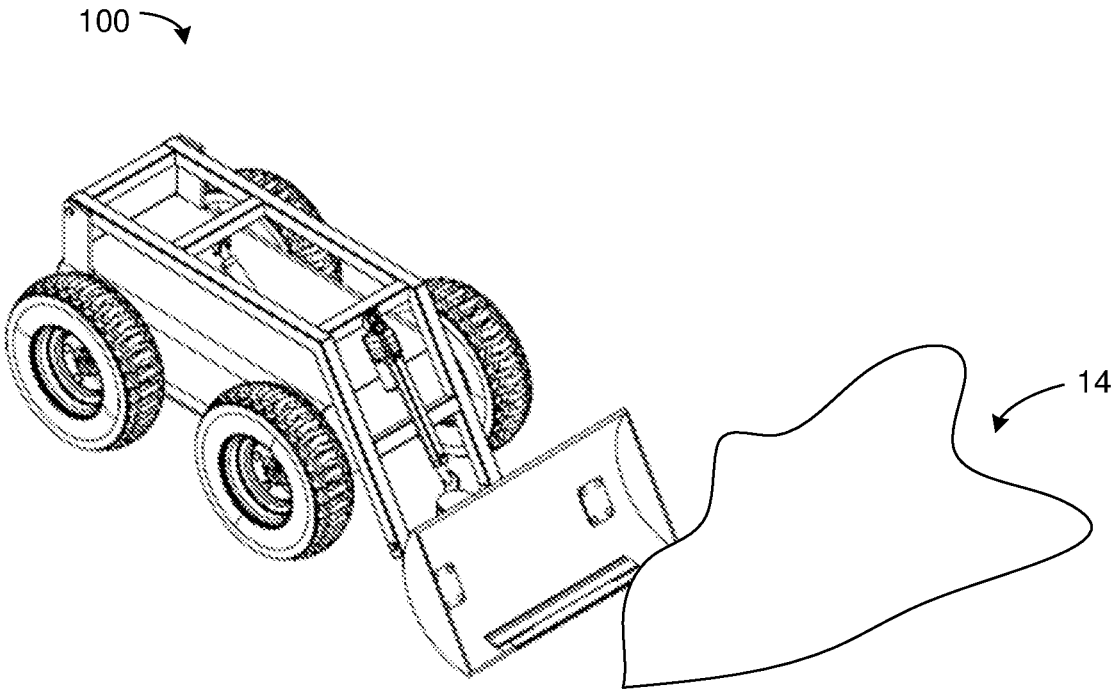

Referring also to the example of FIG. 13A and in some embodiments, autonomous snowbank deconstructing system 100 may be programmed and/or trained to sense snowfall or other accumulation of debris using various artificial intelligence algorithms and sensors. In response to detecting the presence of snow or other scattered material, autonomous snowbank deconstructing system 100 may use the combination of autonomous vehicle 102; boom arms 112, 114; and shovel component 36 to move snow. For example, autonomous snowbank deconstructing system 100 may be configured to orient boom arms 112, 114 such that shovel component 36 is able to scoop snow or other material as autonomous snowbank deconstructing system 100 moves forward. After completing a threshold run length and/or after filling shovel component 36 with a threshold amount of snow or other material, autonomous snowbank deconstructing system 100 may be programmed to lift boom arms 112, 114 and orient shovel component 36 to dump the contents of shovel component 36 into a pile. It will be appreciated that the various run length, shovel component fill threshold, and any other threshold used to determine how to move snow may be defined by various artificial intelligence algorithms. As such, any of these values or variables used to program autonomous snowbank deconstructing system 100 to move snow or other material, are within the scope of the present disclosure. In some embodiments, artificial intelligence algorithms may specify conditions for moving snow.

In some embodiments and as discussed above, dulled motorized instrument 12 may be configured for repetitive, low-impact contact with accumulated snow 14. For example and referring also to FIG. 13B, autonomous snowbank deconstructing system 100 may be programmed or trained using various artificial intelligence algorithms to approach accumulated snow 14 (e.g., a snowbank). Autonomous snowbank deconstructing system 100 may orient boom arms 112, 114 and dulled motorized instrument 12 such that dulled motorized instrument 12 is brought into contact with accumulated snow 14. In some embodiments, dulled motorized instrument 12 may be energized such that at least a portion of dulled motorized instrument 12 makes repetitive, low-impact contact with accumulated snow 14. In this manner, autonomous snowbank deconstructing system 100 may safely reduce accumulated snow 14. In some embodiments, autonomous snowbank deconstructing system 100 may be configured to continuously deconstruct accumulated snow from snowbanks until the snowbanks are reduced to a threshold height or other metric. As such, autonomous snowbank deconstructing system 100 may be configured to exchange the use of inherently dangerous machinery operating with great force (e.g., snow blower augers and impellers) for repetitive, low-impact contact with accumulated snow, operating over longer periods of time. Accordingly, autonomous snowbank deconstructing system 100 may be configured to continuously deconstruct snowbanks in a manner that is safe in the event of accidental human contact.

In some embodiments, autonomous snowbank deconstructing system 100 may include an autonomous vehicle, one or more boom arms coupled to the autonomous vehicle, and a dulled shovel component coupled to the one or more boom arms. For example and as discussed above, autonomous snowbank deconstructing system 100 may include autonomous vehicle 102 with boom arms 112, 114 coupled to autonomous vehicle 102, and dulled shovel component 36 coupled to boom arms 112, 114. In some embodiments, autonomous snowbank deconstructing system 100 may allow autonomous systems to safely and effectively move snow and deconstruct accumulated snow.

For example and as discussed above, autonomous snowbank deconstructing system 100 may be configured as a skid-steer loader or front end loader. In this manner, autonomous snowbank deconstructing system 100 may be configured to move snow (e.g., with dulled shovel component 36)

safely and effectively by repetitively scooping up small amounts of loose snow or debris and, using the combination of boom arms 112, 114 and dulled shovel component 36, may lift the scooped snow over obstacles e.g., to minimize the size of snow piles. In some embodiments, autonomous snowbank deconstructing system 100 may be configured to repetitively scoop and lift small amounts of snow using dulled shovel component 36 to form snow piles. In this manner, the repetitive, low-impact contact with the loose and/or accumulated snow may prevent injury during accidental human contact with autonomous snowbank deconstructing system 100.

As discussed above and in some embodiments, autonomous snowbank deconstructing system 100 may be configured with a dulled shovel component (e.g., dulled shovel component 36). In this manner, autonomous snowbank deconstructing system 100 may not include sharp edges or other pinch points that may cause injury during accidental human contact.

In some embodiments, autonomous snowbank deconstructing system 100 may be configured to autonomously gather loose debris to form one or more debris piles with repetitive, low-impact contact of the dulled shovel component with the loose debris. As discussed above and in some embodiments, autonomous snowbank deconstructing system 100 may be configured to perform a particular task using a combination of one or more sensors, one or more computing devices, and various artificial intelligence algorithms configured to drive various components of autonomous snowbank deconstructing system 100. For example, autonomous snowbank deconstructing system 100 may include one or more computing devices with various artificial intelligence algorithms configured to receive sensor data and provide commands to autonomous vehicle 102 to e.g., move the autonomous vehicle to a certain location at a particular speed; lift and lower boom arms 112, 114; move dulled shovel component 36 into a particular position; etc. to allow autonomous snowbank deconstructing system 100 to autonomously gather loose debris to form one or more debris piles. As discussed above, the programmed movements of each component (e.g., autonomous vehicle 102; boom arms 112, 114; dulled shovel component 36; etc.) may be small, slow, and/or at a low power to not pose a threat during accidental human contact.

Referring again to the example of FIG. 13A and in some embodiments, autonomous snowbank deconstructing system 100 may be configured to orient boom arms 112, 114 such that dulled shovel component 36 is able to scoop snow or other material as autonomous snowbank deconstructing system 100 moves forward. After completing a threshold run length and/or after filling dulled shovel component 36 with a threshold amount of snow or other material, autonomous snowbank deconstructing system 100 may be programmed to lift boom arms 112, 114 and orient dulled shovel component 36 to dump the contents of dulled shovel component 36 into a pile. It will be appreciated that the various run length, shovel component fill threshold, and any other threshold used to determine how to move snow may be defined by various artificial intelligence algorithms. As such, any of these values or variables used to program autonomous snowbank deconstructing system 100 to move snow or other material, are within the scope of the present disclosure. In some embodiments, artificial intelligence algorithms may specify conditions for moving snow. In this manner, dulled shovel component 36 may be configured to be safe to human touch during the repetitive, low-impact contact of the dulled shovel component with the loose debris.

In some embodiments, autonomous snowbank deconstructing system 100 may be configured to autonomously deconstruct accumulated debris with repetitive, low-impact contact of the dulled shovel component with the accumulated debris. As discussed above and in some embodiments, autonomous snowbank deconstructing system 100 may orient boom arms 112, 114 and dulled shovel component 36 such that dulled shovel component 36 is brought into contact with accumulated snow 14. In some embodiments, dulled shovel component 36 may be energized such that at least a portion of dulled shovel component 36 makes repetitive, low-impact contact with accumulated snow 14. In this manner, autonomous snowbank deconstructing system 100 may safely reduce accumulated snow 14.

In some embodiments, autonomous snowbank deconstructing system 100 may be configured to continuously deconstruct accumulated snow from snowbanks until the snowbanks are reduced to a threshold height or other metric. As such, autonomous snowbank deconstructing system 100 may be configured to exchange the use of inherently dangerous machinery operating with great force (e.g., snow blower augers and impellers) for repetitive, low-impact contact with accumulated snow, operating over longer periods of time. Accordingly, autonomous snowbank deconstructing system 100 may be configured to continuously deconstruct snowbanks in a manner that is safe in the event of accidental human contact.

In some embodiments, autonomous snowbank deconstructing system 100 may include a dulled motorized instrument coupled to the autonomous vehicle and configured to make repetitive, low-impact contact with accumulated debris. As discussed above and referring again to the example of FIG. 8, autonomous snowbank deconstructing system 100 may include dulled motorized instrument 12 coupled to autonomous vehicle 102. In some embodiments, dulled motorized instrument 12 may be configured to make repetitive, low-impact contact with accumulated debris. In this manner, autonomous snowbank deconstructing system 100 may safely reduce accumulated snow 14 by repetitively making low-impact contact with accumulated snow 14.

In some embodiments, the one or more booms arms may include a first boom arm coupled to one end of the dulled shovel component and a second boom arm coupled to an opposite end of the dulled shovel component. Referring again to the examples of FIGS. 8-9 and 11 and in some embodiments, autonomous snowbank deconstructing system 100 may be configured as a skid-steer loader or front end loader. In some embodiments, boom arm 112 may be coupled to one end of dulled shovel component 36 and boom arm 114 may be coupled to the opposite end of dulled shovel component 36. In this manner, autonomous snowbank deconstructing system 100 may be configured as an autonomous front end loader where autonomous vehicle 102 may be configured to operate boom arms 112, 114 to orient dulled shovel component 36. In some embodiments, autonomous snowbank deconstructing system 100 may be configured (e.g., via one or more computing devices and various artificial intelligence algorithms in communication with one or more sensors and motorized components of autonomous vehicle 102) to orient dulled shovel component 36 for scooping debris; lifting debris; forming snow piles; making repetitive, low-impact contact with accumulated snow; and other tasks for safely moving snow and/or deconstructing accumulated snow.

In some embodiments, one or more of the first boom arm and the second boom arm may be telescoping boom arms. For example and referring again to the example of FIG. 11, autonomous snowbank deconstructing system 100 may be configured to utilize the combination of telescoping boom arms 112, 114 and dulled shovel component 36 to form snow piles. In some embodiments, by telescoping or extending, boom arms 112, 114 may allow autonomous snowbank deconstructing system 100 to build larger snow piles and/or to move snow or other debris over obstacles. For example, compared to continuously pushing snow into a snowbank, autonomous snowbank deconstructing system 100 may utilize telescoping boom arms 112, 114 and dulled shovel component 36 to lift and move snow over existing snowbanks to clear more surface area. In this manner, autonomous snowbank deconstructing system 100 may avoid using significant power or energy to continuously push against accumulated snow by, instead, lifting snow over an existing snow pile to form or supplement smaller snow piles.

In some embodiments, autonomous snowbank deconstructing system 100 may include various components configured to form the one or more snow piles in addition to and/or instead of the one or more boom arms. For example, autonomous snowbank deconstructing system 100 may include a catapult launcher, an impeller/blower system, a conveyor system, or any other component configured (e.g., by the combination of the one or more computing devices and the various artificial intelligence algorithms) to operate slowly, with low-impact, and/or at a low power to avoid any harm to accidental human contact.

GENERAL

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

A number of implementations have been described. Having thus described the disclosure of the present application in detail and by reference to embodiments thereof, it will be apparent that modifications and variations are possible without departing from the scope of the disclosure defined in the appended claims.

What is claimed is:

1. A autonomous snowbank deconstructing system comprising:

an autonomous vehicle;

one or more boom arms coupled to the autonomous vehicle;

a shovel component coupled to the one or more booms arms; and a dulled motorized instrument coupled to the shovel component and configured to make repetitive, low-impact contact with accumulated snow, wherein the dulled motorized instrument includes a dulled saw configured to actuate along at least one of a lateral axis and a longitudinal axis of the shovel component.

2. The autonomous snowbank deconstructing system of claim 1, wherein the dulled motorized instrument is configured to be safe to human touch during the repetitive, low-impact contact with the accumulated snow.

* * * * *